US006275666B1

(12) United States Patent
Furukawa et al.

(10) Patent No.: US 6,275,666 B1
(45) Date of Patent: Aug. 14, 2001

(54) DEVELOPING DEVICE AND IMAGE FORMATION APPARATUS

(75) Inventors: Kazuhiko Furukawa; Shigeru Nishio; Hiroyuki Hirakawa, all of Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/657,683

(22) Filed: Sep. 8, 2000

(30) Foreign Application Priority Data

Sep. 10, 1999 (JP) ..... 11-256481
Sep. 1, 2000 (JP) ..... 2000-265673

(51) Int. Cl.[7] ..... G03G 15/06
(52) U.S. Cl. ..... 399/55
(58) Field of Search ..... 347/118, 143; 399/50, 55, 56, 168, 169, 170, 274, 284, 285, 291, 292

(56) References Cited

U.S. PATENT DOCUMENTS 4,194,830 * 3/1980 Ohnuma et al. ..... 399/55
5,887,233 * 3/1999 Abe et al. ..... 399/284
6,057,866 * 5/2000 Haneda et al. ..... 347/118

FOREIGN PATENT DOCUMENTS 10-148999 6/1998 (JP) .

* cited by examiner

*Primary Examiner*—Arthur T. Grimley
*Assistant Examiner*—Hoang Ngo
(74) *Attorney, Agent, or Firm*—Dike, Bronstein, Roberts Cushman IP Group; David G. Conlin; David A. Tucker

(57) ABSTRACT

A developing device includes a developer carrier having a surface carrying a one-component developer thereon, developer control member abutting against the developer carrier to control a thickness of a layer of the developer, and a charge generation device provided downstream of the developer control member, as seen in a direction of a rotation of the developer carrier, and applying electric charge of a single polarity to a developer layer on the developer carrier, wherein the developer is charged under a condition that internal to the developer layer there occurs small aerial discharge caused by an electric field created by electric charge applied to a surface of the developer layer. Thus, the developing device can use a one-component developer, does not require toner having its components subtly adjusted and can cancel toner charged opposite in polarity, to form an image of high quality.

21 Claims, 12 Drawing Sheets

DEVELOPING DEVICE AND IMAGE FORMATION APPARATUS

BACKGROUND OF THE INVENTION

1. Field of the Invention

The present invention relates generally to developing devices used in image formation apparatus, such as copiers, printers and the like, and particularly to those using a one-component developer.

2. Description of the Background Art

FIG. 16 shows a conventional electrophotography image formation apparatus with a developing device applied to a one-component development system using a one-component developer only of toner. As shown in FIG. 16, opposite to a photoreceptor 1 corresponding an image carrier, there is arranged a developing device 4 which visualizes an electrostatic latent image formed on photoreceptor 1. In general, developing device 4 supports developing roller 41 rotatably opposite in particular to an opening of a development tank 40 housing insulative toner 10. Developing roller 41 is partially exposed at the opening of development tank 40 and thus arranged for example in contact with photoreceptor 1. This contact area serves as a developing area.

One-component toner 10 is fed to a feed roller 42 and adsorbed on a surface of developing roller 41 and to control the amount of toner adsorbed there is provided a control member 43 pressed into contact with the surface of developing roller 41. Toner 10 passes under control member 43 and is thus controlled to have a predetermined amount and thus transported to the developing area borne on a surface of developing roller 41 opposite to photoreceptor 1. In accordance with the electrostatic latent image on the photoreceptor 1 surface the toner is selectively adsorbed and thus developed.

Toner 10 which has not been used in the development is transported to development tank 40 and thus recovered. To remove recovered toner 10 from the developing roller 41 surface, feed roller 42 is arranged, pressed against developing roller 41 to scrape toner 10 off the developing roller 41 surface. Then, feed roller 42 receives new toner 10 and feeds it onto the developing roller 41 surface.

Furthermore, to develop the toner satisfactorily, developing roller 41 normally receives a developing bias voltage which is set to have a voltage value allowing toner 10 to adhere to an electrostatic latent image borne on photoreceptor 1 while preventing toner 10 from adhering to an background of the image borne on photoreceptor 1.

Furthermore, to provide toner 10 adsorbed on developing roller 41 with a predetermined amount of electric charge of a predetermined polarity, the aforementioned control member 43 receives a control voltage to charge toner 10 to have the predetermined polarity. As such, toner 10 past control member 43 is provided by a fixed amount and after it is charged it is transported to the developing area.

Thus, the toner corresponding to a one-components developer can be adsorbed on the developing roller and thus transported to the developing area to allow the toner to adhere to an electrostatic latent image on the photoreceptor to form an image.

In the developing device employing triboelectricity as described above, however, the toner is rubbed against the control member only for a short period of time. As such, the toner is not charged to reach a sufficiently saturated range and each toner particle thus has a different level of electric charge. Furthermore, there are also provided toner uncharged because it has missed the chance to contact the control member, and toner inevitably charged to have a polarity opposite to a desired polarity when it is charged with triboelectricity (hereinafter referred to as "toner charged opposite in polarity"), which results in the developer having different levels of electric charge widely distributed. As such the toner cannot be developed reliably and in particular the toner charged opposite in polarity is developed at a portion other than an image. Thus the image is degraded in quality.

Furthermore, the level of electric charge has its average value significantly varying with the material(s) of the control member and that of the toner, the grain size of the toner, the environment in which the toner is used, and the like. To allow them to have their respective desired values, the material/materials added to the toner is/are adjusted extremely subtly.

Such disadvantages as above can be alleviated by using a corona charger to charge toner, as disclosed for example in Japanese Patent Laying-Open No. 10-148999.

FIG. 17 shows a developing device with a corona charger applied thereto. Toner 10, accommodated in a toner tank 40, is agitated by the rotation of an agitator 47 and transported to a developing roller 41 by the rotation of a feed roller 42. The transported toner 10 is rubbed against and thus adhered to developing roller 41 rotating in the same direction as feed roller 42 and it is rubbed against a control member 43 and thus charged and also formed in a uniform layer. The toner layer formed is more reliably charged by a charger 45 and thus develops an electrostatic latent image formed on photoreceptor 1 rotating in the same direction as developing roller 41. In this method the level of electric charge can have an average value relatively readily controlled and it can be also be provided in a narrow distribution.

The above developing device, however, also inevitably suffers toner charged opposite in polarity for the following reason: toner 10 is rubbed against control member 43 and feed roller 42 as well as each other. As such, when the toner is formed in a layer, it has a surface having a portion negatively charged and another portion positively charged. As such, when the charge level of one toner particle is noted, toner 10 is considered as being partially charged opposite in polarity.

When corona charger 45 charges the toner layer containing the toner charged opposite in polarity, toner 10 with each individual particle charged with a regular polarity as a whole but in effect partially charged with the opposite polarity, and the like, the electric charge generated by corona-discharging moves along a line of electric force, as shown in FIG. 18, and eventually adheres to toner 10. If toner 10 has a portion charged with the opposite polarity along a side thereof allowing the electric charge to adhere thereto (upwards in the figure) then toner 10 has the electric charge of the opposite polarity canceled and is eventually charged with the regular polarity. If toner 10 has a portion charged with the opposite polarity along a side thereof not allowing the electric charge to adhere thereto (downwards in the figure), however, even with a corona charger providing electric charge of a single polarity the electric charge of the opposite polarity is not canceled.

In other words, toner 10 opposite to corona charger 45 can have a desired level of electric charge through corona-charging and toner 10 not present in a surface of a toner particle, i.e., in the toner layer cannot effectively receive electric charge. Furthermore, toner 10 in a particle surface internal to the toner layer also cannot receive the electric charge provided through corona-charging. As such, the electric charge present therein and having the opposite polarity cannot be canceled and as a result only the toner surface facing the charger can have an electric charge as desired.

To overcome this disadvantage its phenomena were studied in detail and as a result there has been found a charging condition capable of canceling the electric charge of the opposite polarity existing in toner.

SUMMARY OF THE INVENTION

An object of the present invention is to achieve stable development and improve image quality by providing a level of electric charge in a reduced distribution range and particularly reducing toner charged opposite in polarity, without using a developer having its components subtly adjusted.

The present invention in one aspect provides a developing device including a developer carrier having a surface carrying a one-component developer thereon, a developer control member abutting against the developer carrier to control a thickness of a layer of the developer, and a charge generation device provided downstream of the developer control member, as seen in a direction of a rotation of the developer carrier, and applying electric charge of a single polarity to a developer layer on the developer carrier, characterized in that the developer is charged with a bias voltage having at least a level where a surface potential of the developer layer no longer increases in proportion to an increase of the bias voltage of the charge generation device.

In one aspect, in the developing device the developer is charged with a bias voltage having at least a level where a surface potential of the developer layer no longer increases in proportion to an increase of the bias voltage of the charge generation device. As such, internal to the developer layer there can be caused a small aerial discharge. Thus in the developer layer the developer or toner charged opposite in polarity can have its electric charge of the opposite polarity canceled to reliably develop the toner to provide an improved image quality.

In the above one aspect the developing device preferably allows the developer to be charged with a bias voltage having at most a level where a charge level of the developer decreases as the bias voltage of the charge generation device increases.

Thus, the toner layer is not messed up nor does the charge generation device have its function degraded.

The present invention in another aspect provides a developing device including a developer carrier having a surface carrying a one-component developer thereon, developer control member abutting against the developer carrier to control a thickness of a layer of the developer, and a charge generation device provided downstream of the developer control member, as seen in a direction of a rotation of the developer carrier, and applying electric charge of a single polarity to a developer layer on the developer carrier, characterized in that the developer is charged at a condition that small aerial discharge occurs in the developer layer by an electric field created by electric charge applied to a surface of the developer layer.

As such in the developing layer the developer or toner can have its electrical charge opposite in polarity cancelled. Thus stable development and hence high image quality can be obtained.

In the above one and another aspects the developing device is preferably characterized in that the surface potential of the developer on the developer carrier is compared with a voltage applied to the charge generation device, to control a condition for charging the developer.

As such, the developer layer can have therein an appropriate small aerial discharge and furthermore the toner layer is not messed up nor does the charge generation device have its function degraded.

In the above one and another aspects the developing device is preferably characterized in that in charging the developer an electric current flowing through the developer carrier is referred to to control a condition for charging the developer.

As such, the developer layer can have therein an appropriate small aerial discharge and furthermore the toner layer is not messed up nor does the charge generation device have its function degraded.

The present invention in one aspect provides an electrostatic latent image formation apparatus including an image carrier bearing an electrostatic latent image, a developer carrier having a surface carrying a one-component developer thereon and contacting the electrostatic latent image carrier in a developing portion or facing the electrostatic latent image carrier in a developing portion with a small gap interposed, a developer control member abutting against the developer carrier to control a thickness of a layer of the developer, and a charge generation device arranged downstream of the developer control member, as seen in a direction of a rotation of the developer carrier, and applying electric charge of a single polarity to a developer layer on the developer carrier, characterized in that the developer is charged with a bias voltage having at least a level where a surface potential of the developer layer no longer increases in proportion to an increase of the bias voltage of the charge generation device.

In one aspect, in the developing device the developer is charged with a bias voltage having at least a level where a surface potential of the developer layer no longer increases in proportion to an increase of the bias voltage of the charge generation device. As such, internal to the developer layer there can be caused a small aerial discharge. Thus in the developer layer the developer or toner charged opposite in polarity can have its electric charge of the opposite polarity canceled to provide reliable development and improve image quality.

In the above one aspect the image formation apparatus preferably allows the developer to be charged with a bias voltage having at most a level where a charge level of the developer decreases as the bias voltage of the charge generation device increases.

Thus, the toner layer is not messed up nor does the charge generation device have its function degraded.

The present invention in another aspect provides an electrostatic latent image formation apparatus including an image carrier bearing an electrostatic latent image, a developer carrier having a surface carrying a one-component developer thereon and contacting the electrostatic latent image carrier in a developing portion or facing the electrostatic latent image carrier in a developing portion with a small gap interposed, a developer control member abutting against the developer carrier to control a thickness of a layer of the developer, and a charge generation device arranged downstream of the developer control member, as seen in a direction of a rotation of the developer carrier, and applying electric charge of a single polarity to a developer layer on the developer carrier, characterized in that the developer is charged at a condition that small aerial discharge occurs in the developer layer by an electric field created by electric charge applied to a surface of the developer layer.

As such in the developing layer the developer or toner can have its electrical charge opposite in polarity cancelled. Thus stable development and hence high image quality can be obtained.

In the above one and another aspects the image formation apparatus is preferably characterized in that a density of an image formed on the electrostatic latent image carrier is referred to to alter a bias voltage of the charge generation device to control a charge level of the developer.

As such, the developer layer can have therein an appropriate small aerial discharge and furthermore the toner layer is not messed up nor does the charge generation device have its function degraded.

The present invention in still another aspect provides an image formation apparatus including a developer carrier having a surface carrying a one-component developer thereon, a developer control member abutting against the developer carrier to control a thickness of a layer of the developer, a charge generation device arranged downstream of the developer control member, as seen in a direction of a rotation of the developer carrier, and applying electric charge of a single polarity to a developer layer on the developer carrier, and a printing head having a control electrode with a plurality of holes to discontinuously jet the developer in response to an electrical signal corresponding to data of an image to be recorded, characterized in that the developer is charged with a bias voltage having at least a level where a surface potential of the developer layer no longer increases in proportion to an increase of the bias voltage of the charge generation device.

In still another aspect, in the image formation apparatus the developer is charged with a bias voltage having at least a level where a surface potential of the developer layer no longer increases in proportion to an increase of the bias voltage of the charge generation device. As such, internal to the developer layer there can be caused a small aerial discharge. Thus in the developer layer the developer or toner charged opposite in polarity can have its electric charge of the opposite polarity canceled to provide reliable development and improve image quality.

In the above, still another aspect the image formation apparatus preferably allows the developer to be charged with a bias voltage having at most a level where a charge level of the developer decreases as the bias voltage of the charge generation device increases.

Thus, the toner layer is not messed up nor does the charge generation device have its function degraded.

The present invention in still another aspect provides an image formation apparatus including a developer carrier having a surface carrying a one-component developer thereon, a developer control member abutting against the developer carrier to control a thickness of a layer of the developer, a charge generation device arranged downstream of the developer control member, as seen in a direction of a rotation of the developer carrier, and applying electric charge of a single polarity to a developer layer on the developer carrier, and a printing head having a control electrode with a plurality of holes to discontinuously jet the developer in response to an electrical signal corresponding to data of an image to be recorded, characterized in that the developer is charged at a condition that small aerial discharge occurs in the developer layer by an electric field created by electric charge applied to a surface of the developer layer.

As such in the developing layer the developer or toner can have its electrical charge opposite in polarity cancelled. Thus stable development and hence high image quality can be obtained.

In the above two still another aspects the image formation apparatus is preferably characterized in that the surface potential of the developer on the developer carrier is compared with a voltage applied to the charge generation device, to control a condition for charging the developer.

As such, the developer layer can have therein an appropriate small aerial discharge and furthermore the toner layer is not messed up nor does the charge generation device have its function degraded.

In the above two still another aspects the image formation apparatus is preferably characterized in that in charging the developer an electric current flowing through the developer carrier is referred to to control a condition for charging the developer.

As such, the developer layer can have therein an appropriate small material discharge and furthermore the toner layer is not messed up nor does the charge generation device have its function degraded.

The present invention in still another aspect provides an image formation apparatus including an image forming body having a surface bearing a developer thereon, and a charge generation device positioned upstream of a position allowing the developer on the image forming body to be transferred to an image holder, as seen in a direction in which the image forming body rotates, for applying electric charge of a single polarity to the developer on the image forming body, characterized in that the developer is charged with a bias voltage having at least a level where a surface potential of the developer layer no longer increases in proportion to an increase of the bias voltage of the charge generation device.

The present invention in still another aspect provides the image formation apparatus wherein the developer is charged with a bias voltage having at least a level where a surface potential of the developer layer no longer increases in proportion to an increase of the bias voltage of the charge generation device. As such, there can be caused a small aerial discharge internal to the developer layer. This can increase a charge level of the developer layer and further cancel toner charged opposite in polarity to transfer the developer with high fidelity and provide an improved image quality.

In the image formation apparatus in the above, still another aspect the developer is preferably charged with a bias voltage having at most a level where a charge level of the developer decreases as the bias voltage of the charge generation device increases.

Thus, the developing layer is not disturbed and the charge generation device is not degraded in function.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The present invention will now be described in detail.

First Embodiment

Figure 1:
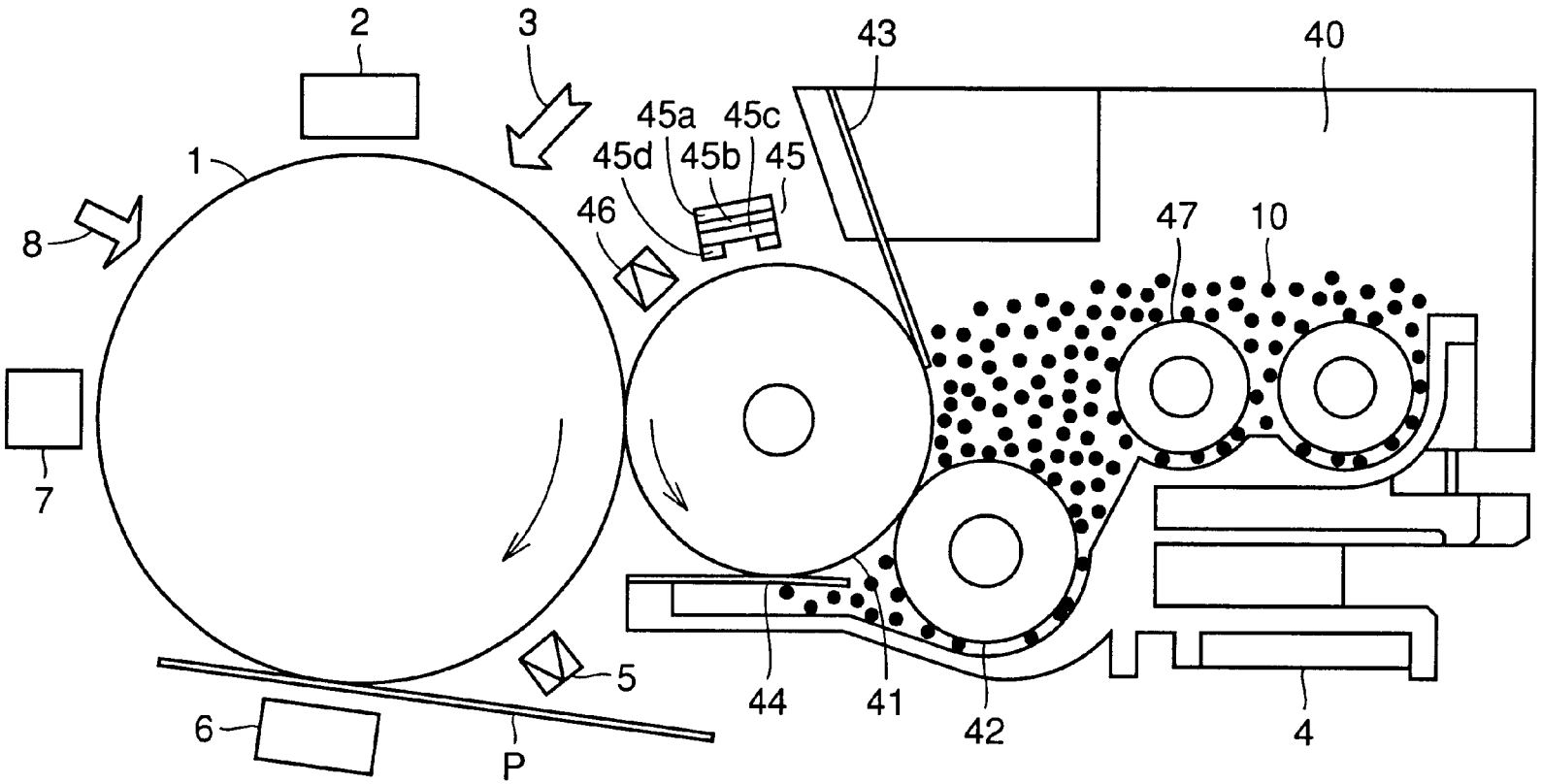
FIG. 1 is a schematic view of an image formation apparatus in an electrophotography system.

As shown in FIG. 1, an image formation apparatus is provided with a photoreceptor 1 arranged substantially at its center. Around photoreceptor 1 and opposite thereto, there are arranged a charging device 2, an exposure device 3 (not shown), a developing device 4, a density sensor 5, a transfer device 6, a cleaner 7, and an optical discharging lamp 8 (not shown), arranged in the order mentioned above and in the direction of the rotation of photoreceptor 1.

Photoreceptor 1 has a conductive base of metal or resin with an underlying layer applied and thereon is provided as an overlying layer a carrier generating layer CGL and thereon the outermost layer corresponding to a carrier transfer layer CTL containing polycarbonate as a main component, applied in the form of thin film.

Photoreceptor 1 has a surface previously charged by charging device 2 to have a desired potential and thereon exposure device 3 forms a potential of an latent image depending on the image information of interest.

Photoreceptor 1 rotates and the electrostatic latent image thereon is thus moved to a region thereof opposite to developing roller 41 (developing device 4). In the developing area, conductive developing roller 41 at least having its surface formed of an elastic member abuts against photoreceptor 1, so that a developer (referred to as toner hereinafter), previously controlled through the process described hereinafter to provide the toner with a desired level of electric charge and a desired thickness in the form of a layer, moves to photoreceptor 1 according to the pattern of the latent image of interest to visualize the image.

After photoreceptor 1 has had the potential of the latent image visualized with toner 10, photoreceptor 1 rotates or moves past density sensor 5, which measures the density of the tonered image. The image is then transferred to a transfer area, at which transfer device 6 is arranged. The density of the tonered image measured is fed back to a bias voltage control unit (not shown) of charger 45.

The transfer area also receives a transfer sheet P, which is fed by a sheet feeder (not shown). Transfer sheet P is synchronously brought into contact with the tonered image on photoreceptor 1. Transfer device 6 applies voltage of a polarity moving toner 10 from photoreceptor 1 to transfer sheet P to move the tonered image from photoreceptor 1 to transfer sheet P. Transfer sheet P with the tonered image transferred thereon is then transported typically to a device (not shown) provided to melt and thus thermally fix the image on the transfer sheet before the sheet is externally output.

After the passage through the transfer area, any toner that has not been transferred to the sheet and thus remains on photoreceptor 1 is removed from photoreceptor 1 by means of cleaner 7. Then, photoreceptor 1 has its residual charge erased by optical discharging lamp 8 and thus has its potential refreshed and photoreceptor 1 thus returns to the initial step.

It should be noted that charged photoreceptor 1 has its potential of electric charge refreshed or canceled through exposure, i.e., by a carrier generated from layer CGL by means of a lamp light for analog machines and typically a laser beam for digital machines.

Developing device 4 will now be described in detail.

Toner 10, accommodated in developing device 4 at a toner tank (referred to as a hopper hereinafter) 40, is transported towards developing roller 41 by means of a screw 47.

Developing roller 41 has a rotation axis made of stainless steel and having a diameter of 18 mm with its surface covered with a semiconducting elastic layer of 8 mm thick. A matrix of the semiconducting elastic layer is formed of urethane resin with carbon black distributed therein as required to adjust the resistance of the elastic layer.

Developing roller 41 abuts against a toner feeding roller 42, which is arranged opposite to developing roller 41 and rotates in the direction opposite to the that in which developing roller 41 rotates. Toner feeding roller 42 is formed of a material similar to that of developing roller 41 and thus has an electrical resistance adjusted with a resistance adjusting material similar to that applied to developing roller 41. Furthermore, toner feeding roller 42 is also formed of a material foamed to further increase its elasticity and the amount of the foaming agent applied for roller 42 is larger than that applied for roller 41.

Toner feeding roller 42 receives voltage from a bias power supply (not shown). In general, a high level of bias voltage is applied to push toner 10 towards developing roller 41. For example it is applied on the negative polarity side if toner 10 is of negative polarity.

Toner feeding roller 42 feeds toner 10 to developing roller 41. As roller 41 rotates, toner 10 is transported to the location at which roller 41 meets a blade 43 corresponding a member controlling the thickness of the toner layer.

Blade 43, formed of a stainless steel plate of 0.1 mm in thickness is a cantilevered spring plate with a free end abutting against developing roller 41. As such, toner 10 fed to developing roller 41 is controlled to have a predetermined thickness depending on the blade 43 pressure, position and the like set as required. Furthermore, blade 43 receives voltage from a bias power supply (not shown) to push toner 10 towards developing roller 41. For example, if toner 10 is of negative polarity, then a high level of bias voltage is applied on the negative polarity side, or a bias voltage achieving the same potential as developing roller 41 is applied.

Then, the toner layer is transported to a location opposite to charger 45. Charger 45 is formed of an insulative supporting substrate 45*a* with an electrode A45*b*, an insulating layer 45*c* and an electrode B45*d* stacked thereon. When charger 45 operates, the electric charge generated in a vicinity of electrode B45*d* is ejected towards a surface of the toner layer through an electric field attributed to the bias voltage and the surface potential of the toner layer and the electric charge thus adheres to toner 10 and thus charges toner 10.

The charged toner layer moves past the surface facing a surface potential sensor 46 and it is thus transported to the developing area (an area facing photoreceptor 1) to proceed with the developing step. The toner layer's surface potential measured by surface potential sensor 46 is fed back to the bias voltage control unit (not shown) of charger 45.

The toner which has not been used in the developing step and thus remains on developing roller 41 returns to developing device 4 as developing roller 41 rotates, although after its passage through the developing area the toner remaining on roller 41 has its charge removed by a discharging device 44 arranged before toner feed roller 42 and it is then pressed into contact with feeding roller 42 and thus removed and recovered into hopper 40 and thus reused.

Discharging device 44 is an elastic member in the form of a thin plate having a portion in contact with the developer carrier via the developer layer that is formed of a low-resistance material or metal material of no more than 10 kΩ in resistance. Discharging device 44 may alternatively be a roller member having a portion in contact with the developer carrier via the developer layer that is formed of a low-resistance material or metal material of no more than 10 kΩ in resistance. Discharging device 44 in the form of a roller member can remove the electric charge present in a dielectric layer provided on developing roller 41 as well as remove from developing roller 41 the toner which has not been used in the developing step and thus remains on the roller 41.

If discharging device 44 is an elastic member in the form of a plate, the elastic member has one end fixed to developer tank 4 to press it against developing roller 41 as appropriate and it also has a surface proximal to a free end that is pressed into contact with developing roller 41 through the spring performance of the elastic member. Furthermore, receiving a bias voltage Vd from a power supply circuit (not shown), after the developing step the elastic member removes the electric charge of a dielectric layer provided on developing roller 41 and also discharges the toner recovered and removes the same.

As such, the elastic member is mainly formed of nylon, polyethylene terephthalate (PET), polytetrafluoroethylene (PTFE) containing resin, polyurethane and the like, with carbon or the like used as a material for adjusting the electric resistance of the elastic member, as appropriate. Discharging device 44 having such a resistance as described above receives a reset voltage Vd from the power supply. Voltage Vd may be a ground voltage (0V) or an alternate current of approximately ±800 V.

In the above, the elastic member has its electrical resistance adjusted with no less than 10 parts by weight (in some case, no more than 70 parts by weight) of carbon black having a nitrogen adsorbing, specific surface area of 20 $m^2/g$ to 130 $m^2/g$, such as furnace or channel black for example of ISAF, HAF, GPF, SRF and the like, mixed in 100 parts by weight of polyurethane, which is similarly applied for nylon, PET and other resins.

Toner 10 is fine particles having an average grain size of 8 μm formed mainly of a styrene-acryl copolymer with carbon black added thereto. Blade 43 forms toner 10 in a layer having a thickness of approximately 30 μm and a pack density of approximately 50%.

Developing roller 41 has a volume resistance of $6\times10^6$ Ωcm and has a rubber hardness corresponding to an Ascar C hardness of 65 degree and it has a width of approximately 1.5 mm brought into contact with photoreceptor 1 and rotates at a rate of 200 mm/s as measured circumferentially.

In forming an image, developing roller 41 for example receives a voltage of −400 V, feeding roller 42 receives −500 V (the developing roller's potential minus 100 V), blade 43 receives −500 V (the developing roller's potential minus 100 V), the charger's electrode A45*b* corresponds to an alternate voltage of 10 kHz ±2 kV with a bias voltage of −700 V (the developing roller's potential minus 300 V) applied, and the charger's electrode B45d receives the same voltage as electrode A, i.e., −700 V (Hereinafter, the electrode B voltage minus the developing roller's voltage, −300 V in the above example, will be referred to as the charger's bias voltage. It should be noted that toner 10 does not contain an agent controlling the polarity with which toner 10 is charged nor the charge level of toner 10 and it is thus slightly negatively charged immediately after it has moved past blade 43.

The above image formation apparatus was subjected to the following experiment to measure the amount of toner charged opposite in polarity.

A developing bias voltage (i.e., the difference between the potential of developing roller 41 and that of a portion on photoreceptor 1 that does not have an image) of +200 V is set and feeding roller 42 and blade 43 have their respective potentials set in the relationship described above, with charger 45 providing a bias voltage varying from −100 V, −200 V to −300 V, while toner 10 on photoreceptor 1 at the non-image portion (of 0 V in the present measurement, although approximately −700 V when an image is formed) is taken on an adhesive tape. The tape is then stuck on a piece of white sheet to estimate the amount of the toner in the form of an OD value obtained by means of a Macbeth densitometer. The results are presented in Table 1. Since the toner is developed with a developing bias voltage applied opposite in polarity to a regular developing bias voltage, the toner is charged opposite in polarity to the regular (negative) polarity and it is thus believed that smaller amounts of toner adhering to the white sheet indicate that there are smaller amounts of toner charged opposite in polarity. It should be noted that the tape on the white sheet without the toner adhering thereto had an OD value of 0.085.

TABLE 1

| Bias voltage | OD value |
|---|---|
| −100 | 0.187 |
| −200 | 0.173 |
| −300 | 0.095 |

Table 1 reveals that a significantly small amount of toner charged opposite in polarity exists when charger 45 provides the bias voltage of −300 V.

This result is considered, as provided below.

Figure 2:
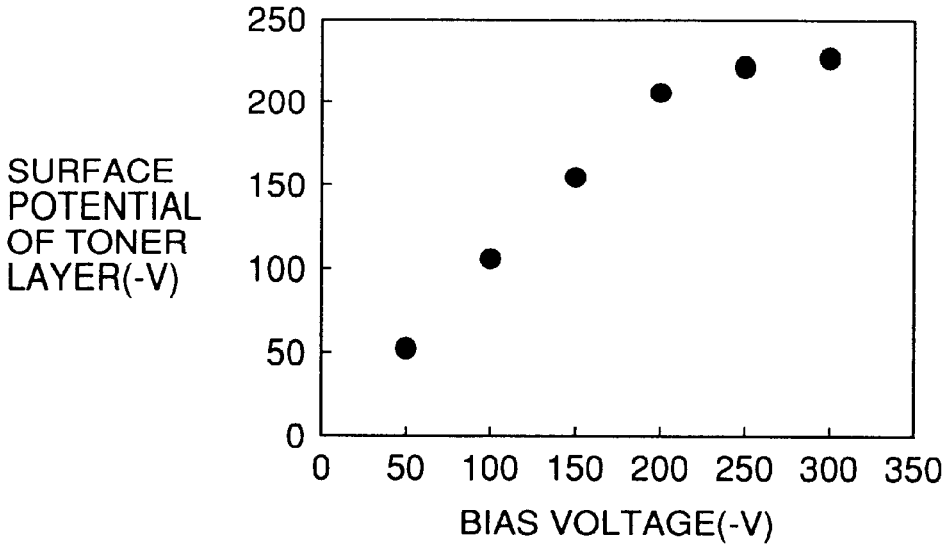
FIG. 2 is a graph of the surface potential of a toner layer versus the bias voltage of a charger.
Figure 3:
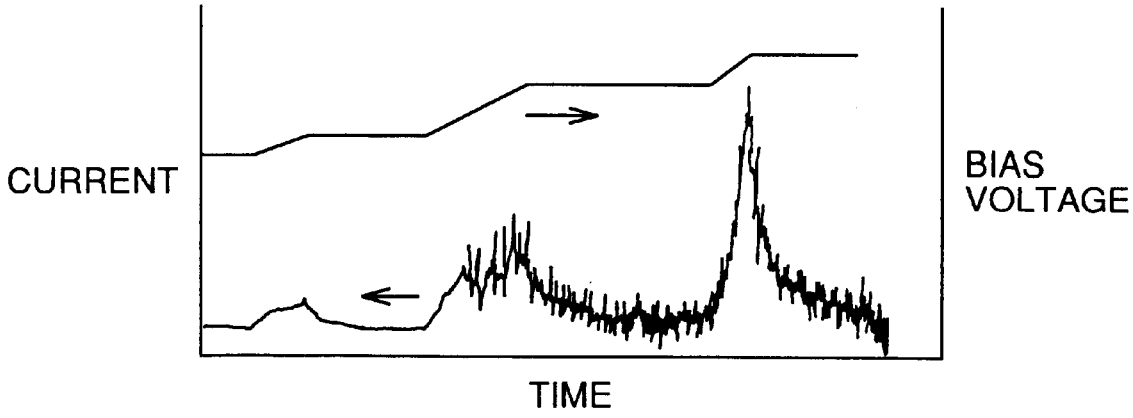
FIG. 3 represents the level of an electric current observed at a developing roller when discharge occurs internal to a toner layer.

As shown in FIG. 2, the toner layer has a surface potential Vs linearly increasing until the charger 45 bias voltage reaches −200 V, (i.e., surface potential Vs of the toner layer is nearly equal to the bias voltage of charger 45), and it does not linearly increases when charger 45 provides the bias voltage of −300 V, i.e., surface potential Vs does not vary as much as the bias voltage, when there is observed a pulsed current flowing in developing roller 4, as represented in FIG. 3. In this condition the electric charge distributing in the toner layer was measured and there was hardly observed electric charge present internal to the toner layer.

From the above result it is believed that as the charger 45 bias voltage increases the toner layer also has a surface with more electric charge adhering thereto and when such electric charge creates in the toner layer an electric field exceeding a value the toner layer has an aerial gap with the air therein ionized, which is observed as the pulsed current.

Such aerial discharge in the toner layer sporadically occurs at anywhere in such aerial gap. Thus in the toner layer a sort of plasma is created.

Figure 4:
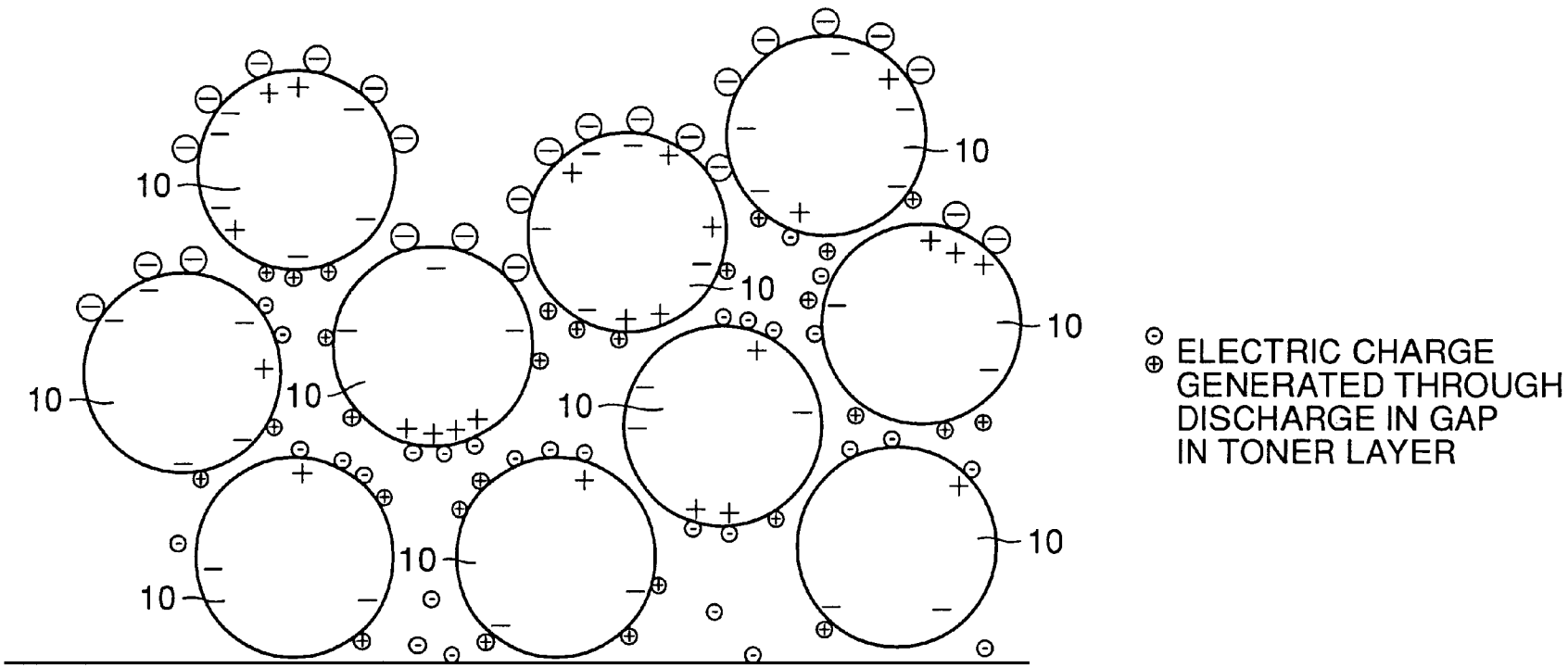
FIG. 4 is an image of toner charged when discharge occurs internal to a toner layer.

As shown in FIG. 4, while the toner layer has a surface charged by charger 45 to have a desired polarity, the toner layer also has a portion distant from the surface that is charged opposite in polarity through friction and the like (in the figure, represented by the symbol "+" internal to the toner) and the portion charged opposite in polarity is preferentially canceled by the negative one of the paired positive and negative charges generated through the aerial discharge described above.

Furthermore, the other electric charge generated by such aerial discharge (the positive charge in this example) is canceled by the negative electric charge generated by further aerial discharge. While this is repeated an electric field created in the toner layer allows the positive charge to move towards the surface of the toner layer and thus adhere to toner 10 present in an upper layer. Eventually, the positive charge adheres to a back side of toner 10 present in the outermost layer. It should be noted that the positive charge level on the back side of the toner 10 outermost layer is significantly smaller than the charge level of the desired polarity charged by charger 45 and toner 10 per se is thus charged with the desired polarity.

In contrast, the negative charge generated through such aerial discharge that has failed to recouple with the electric charge of a portion of toner 10 charged opposite in polarity, the positive charge generated through the aerial discharge, and the like, moves in the direction of the depth of the toner layer and eventually flows into developing roller 41.

As such, it is believed that the electric charge internal to the toner layer is almost or close to zero.

The above-described discharge in the toner layer occurs for more than a level of bias voltage, although a bias voltage set much higher than that starting the discharge in the toner layer would result in the toner layer having therein an intense discharge and toner particles thus spouting out. As such, the toner layer would be messed up and adhere to the charger and thus degrade the function thereof. As such, the voltage should be carefully set.

A bias voltage is optimally set by exploiting the fact that when the toner layer has internal discharge its surface potential does not reach the bias voltage applied and thus gradually saturates or when the toner layer has internal discharge the developing roller has flowing therethrough an electric current corresponding to the movement of the charge attributed to the discharge, on top of the charged electric charge, as has been described with reference to FIG. 2.

Before an image forming operation is performed when the roller is previously rotated a slightly lower voltage (e.g., of −200 V) is initially applied as a bias voltage and then gradually increased as the surface potential of the toner layer (i.e., the output from surface potential sensor 46) is compared with the bias voltage of the charger. The difference between the bias voltage and the surface potential is fed back to a bias voltage control unit (not shown) and when the difference has reached a predetermined value (for example of 70 V) the current bias voltage is once held and the image forming operation is then started and during the image forming operation the surface potential is held constant by controlling the bias voltage. Alternatively, the current flowing through the developing roller is held to have a predetermined value by setting the bias voltage in a manner similar to the above manner. Thus, the toner does not disadvantageously affected by the discharge internal to the toner layer and can thus be charged satisfactorily.

While the above description is provided with reference to an example with a bias voltage applied whenever the image forming operation is performed, the bias voltage can also be applied only in the initialization operation upon power-on if the process is required to be simplified.

Figure 5:
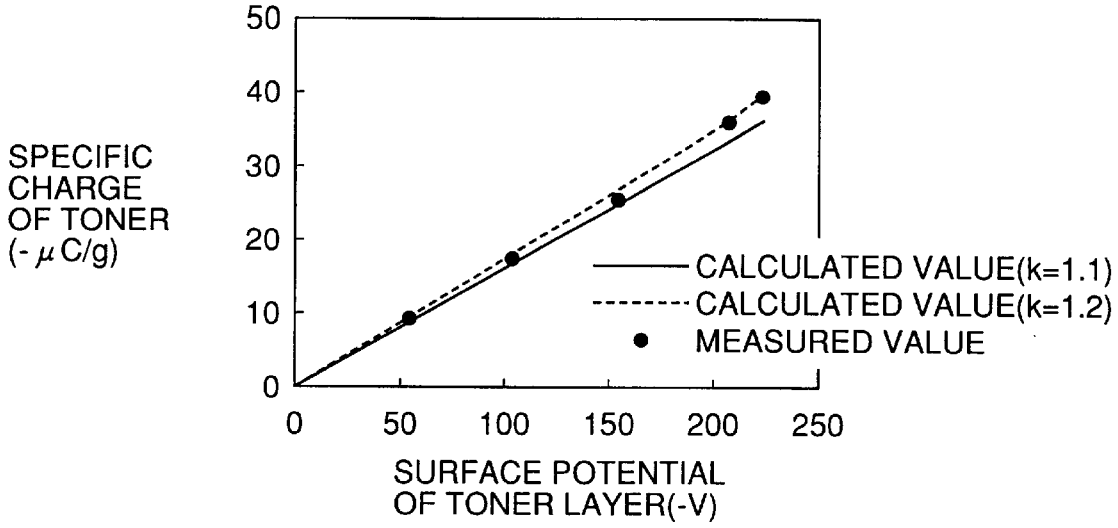
FIG. 5 is a graph of the averaged level of the toner charge to mass ration versus the surface potential of a toner layer.

Then, under the image developing condition, with the photoreceptor having approximately 0 V, the toner was developed and, as shown in FIG. 5, there has been found a proportional relationship between the averaged the developed toner charge to mass ration q and the surface potential Vs of the toner layer on the developing roller.

This relationship was examined in detail and it has been found to be:

$$q/m=k\cdot\epsilon\cdot Vs/(d^2\cdot\rho\cdot\delta) \quad (1)$$

wherein q/m: averaged toner charge to mass ration $\epsilon$: dielectric constant of toner layer Vs: surface potential of toner layer d: thickness of toner layer $\rho$: specific gravity of toner $\delta$: pack density of toner of toner layer and k is 1.1 to 1.2 under any charging condition. As such, if in expression (1) $\epsilon$, d, $\rho$ and $\delta$ are known then by controlling the toner's surface potential Vs allows the average of charge to mass ration q/m can be readily controlled.

Furthermore, a charge to mass ration larger than the optimal value results in a reduced image density and that smaller than the optimal value provides an increased image density. As such, image density can be an index of the value of charge to mass ration to be controlled.

As such, if an image density on the photoreceptor is smaller than a predetermined value then the toner charge to mass ration can be reduced or the charger's bias voltage can be reduced and if an image density on the photoreceptor is larger than the predetermined value then the toner charge to mass ration can be increased or the charger's bias voltage can be increased (the density sensor 5 output is fed back to the bias voltage control unit (not shown)) to allow the apparatus to provide stable image formation with a constant image density if the apparatus is used in different environments for different periods of time with different developers having various triboelectric characteristics.

Figure 6:
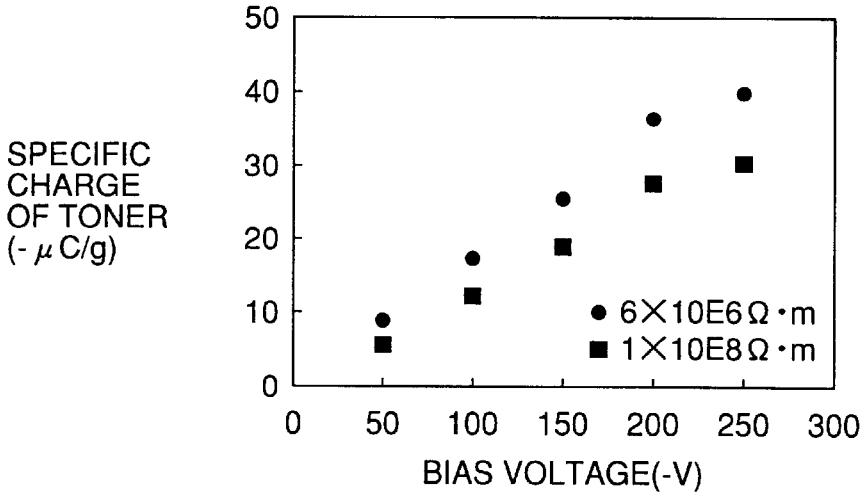
FIG. 6 is a graph of the averaged level of the toner charge to mass ration versus the bias voltage of a charger.

FIG. 6 is a graph of the level of the toner charge to mass ration versus the bias voltage of the charger for developing roller 41 having a voltage resistance of $6\times10^6$ Ω cm and developing roller 41 unchanged in composition although the amount of carbon black distributed is reduced to allow the roller to have a volume resistance increased to $1\times10^8$ Ω cm. As shown in FIG. 6, the toner charge to mass ration relative to the charger's bias voltage for the voltage resistance of $1\times10^8$ Ω cm is lower than that for the voltage resistance of $6\times10^6$ Ω cm.

This is because when the toner layer on developing roller 41 attains the same potential as the charger's bias voltage no more electric charge is supplied, so that when the developing roller 41 has a capacitive component appearing, the roller and the toner layer together provide a reduced electrostatic capacity and the toner is thus supplied thereon with a reduced level of electric charge.

Not to carelessly increase the voltage, it is better to provide a substantially conductive developing roller 41. "Substantially conductive" herein means that the capacitive component as described above does not appear. This capacitive component essentially depends on complex permittivity, although it also has a strong correlation with voltage resistivity and it is thus not disadvantageous for a voltage resistivity of no more than approximately $1\times10^7$ Ω cm.

Thus it has been found that it is better to provide a conductive developing roller 41.

Then, further consideration was given to increasing the level of the toner charge to mass ration with conductive developing roller 41 used.

There were prepared developing roller 41 having an rotation axis formed of stainless steel of 18 mm in diameter and having a surface provided thereon with a semiconducting elastic layer of 8 mm in thickness covered with a film of PET of 10 μm in thickness, and developing roller 41 excluding the PET film. On each roller a toner layer was formed to measure the relationship between bias voltage and the level of the charge to mass ration of the surface layer of the toner layer. It has been found that developing roller 41 with the insulating PET film allows a higher discharge starting electric field in the toner layer and as a result can provide the toner with a high electric charge. This may be because the voltage elevation that can be held in the toner layer is larger than the voltage drop in the PET film.

It should be noted that in the FIG. 1 electrophotography process, too high a level of charge to mass ration also disadvantageously results in a degraded image density and there should be provided an optimized level of charge to mass ration for the recording apparatus of interest.

Second Embodiment

In the present embodiment the amount of toner charged opposite in polarity was measured under a condition different than in the first embodiment.

In the FIG. 1 apparatus, blade 43 abuts against developing roller 41 with the blade's pressure against the roller adjusted, developing roller 41, feed roller 42 and blade 43 receive −300 V, −400 V and −450 V, respectively, and on developing roller 41 is formed a toner layer formed of an average particle diameter of 6 μm and having a thickness of approximately 8 μm (as converted with weight and a pack density of 50% considered). The other conditions and the like were the same as in the first embodiment.

Figure 7:
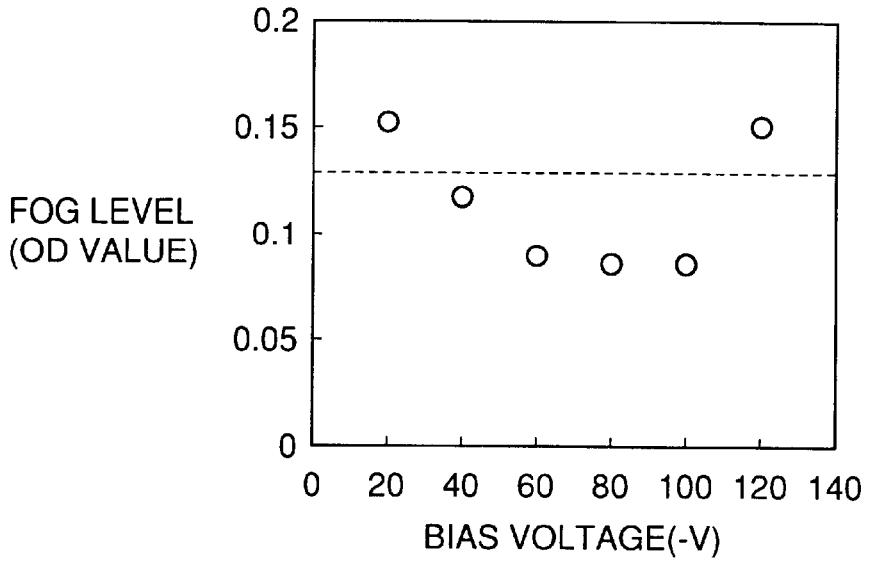
FIG. 7 is a graph of the density of toner charged opposite in polarity versus the bias voltage of a charger.

The toner layer reduced in thickness can be expected to provide a development according to the latent image of interest with high fidelity. A method similar to that applied in the first embodiment was employed to measure the amount of toner adhering on photoreceptor 1 charged to approximately −700 V with the charger having different levels of bias voltage. The results are shown in FIG. 7.

It can be seen in the figure that a significantly small amount of toner charged opposite in polarity is obtained when the charger provides a bias voltage of −40 V to −100 V.

Figure 8:
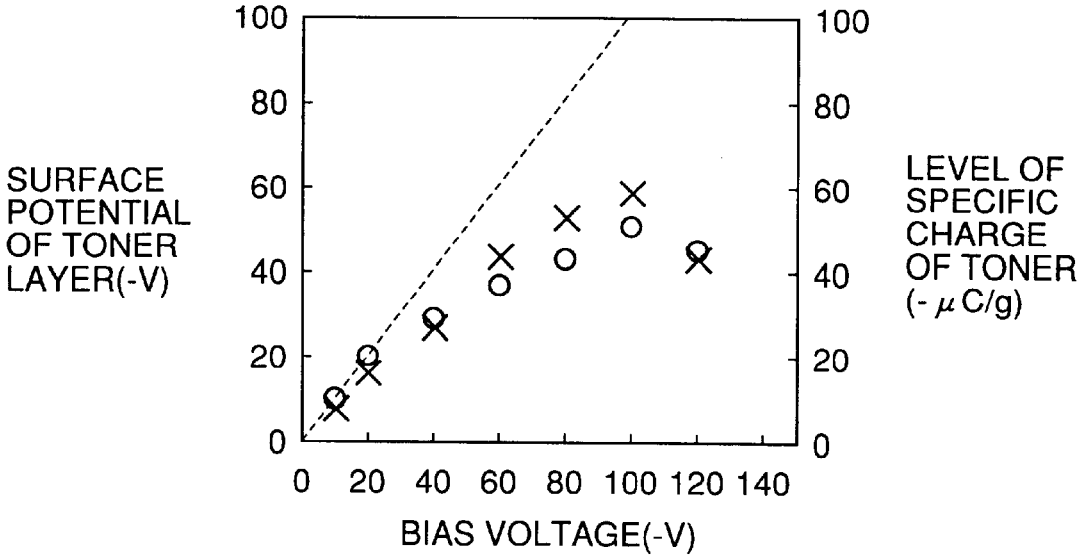
FIG. 8 is a graph of the surface potential of a toner layer and the averaged level of the toner charge to mass ration versus the bias voltage of a charger.

FIG. 8 is a graph of surface potential Vs of the toner layer on developing roller 41 and the toner charge to mass ration measured at a location where the toner is brought into contact with photoreceptor 1 versus the bias voltage of the charger. It can be seen from FIG. 8 that when the bias voltage is more negative than −40 V the potential Vs cannot follow the bias voltage and when the bias voltage is more negative than −120 V the toner charged opposite in polarity increases and the charge to mass ration and surface potential Vs drop. Thus, under a charging condition above the absolute value of a bias voltage that surface potential Vs fails to follow and below the absolute value of a bias voltage with surface potential Vs (or the toner's charge level) dropping, there can be formed an image free of such fog as attributed to toner charged opposite in polarity. It should be noted that when as in the present embodiment toner has a grain size small relative to the thickness of the layer some of the charging electrical charge supplied flows directly into the developing roller and thus buried in that current there was not clearly observed a current pulsed as represented in FIG. 3. Furthermore, in the present apparatus for a bias voltage of −20 V the toner layer has a surface potential Vs of −19 V. However, if for example the charger's position is changed or a high voltage is applied then the charge acceptance might not completely match the bias voltage and can be offset upwards or downwards. As such, the bias voltage that cannot be followed, as described above, does not mean a voltage with the toner layer's surface potential Vs smaller than the bias voltage but a voltage with surface potential Vs out of proportion to the bias voltage (diverting from the dotted line in FIG. 8).

Figure 9:
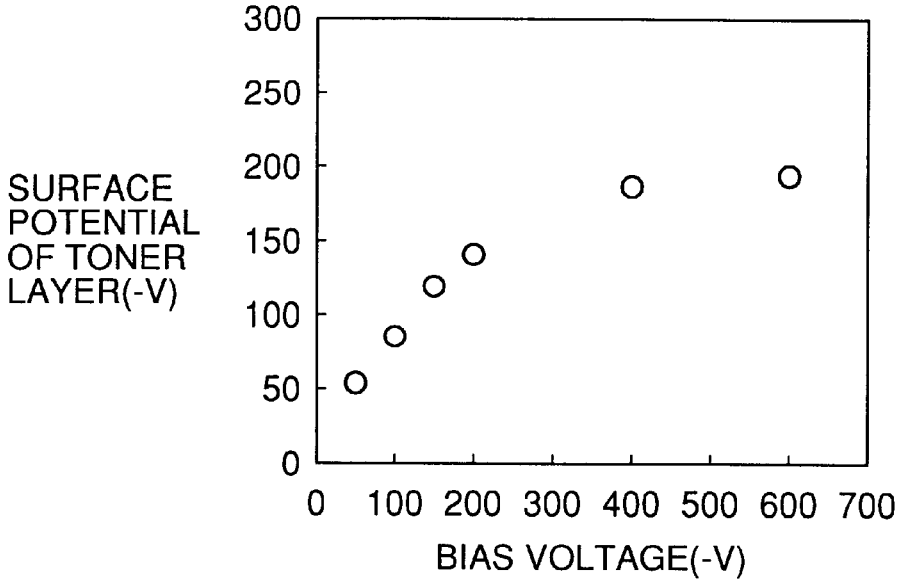
FIG. 9 is a graph of the surface potential of a toner layer and the bias voltage of a charger.

Then, on developing roller 41 having a volume resistance of $5\times10^7$ Ω cm a toner layer similar to that described above was formed and its surface potential Vs' was measured with the charger having different levels of bias voltage. The results are provided in FIG. 9. As has been described previously, although with this developing roller a capacitive component appears and the toner layer's surface potential Vs' increases (Vs'=the toner layer's potential (≈Vs)+the developing roller's potential), there still can be formed an image free of such fog as attributed to toner charged opposite in polarity for more than the absolute value of a bias voltage that the toner layer's surface potential cannot follow. As such, a surface potential of the toner layer measured can be referred to to determine a charging condition and an image density measured can be referred to to control a bias voltage to attain a charge level of a desired value to provide a constant image density to form a stable image, as is when a developing roller without a capacitive component appearing is used. It should be noted, however, that since there does not appear a bias voltage for which the toner layer's surface potential decreases, measuring a surface potential in the process operation would not provide the upper limit of the absolute value of the bias voltage. As such, the upper limit must be obtained previously when the machine is designed.

Third Embodiment

Hereinafter is described another embodiment of the image formation apparatus of the present invention.

Figure 10:
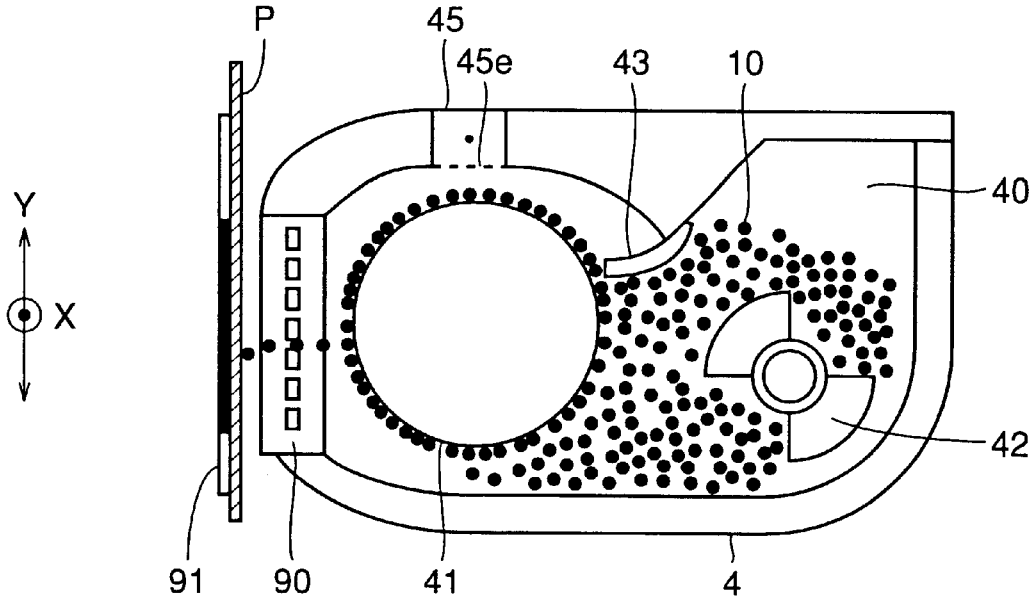
FIG. 10 is a schematic view of another image formation apparatus.

As shown in FIG. 10, developing device 4 has a toner tank 40 accommodating therein toner 10 serving as particles visualizing an image, a developing roller 41 corresponding to a cylindrical toner carrier carrying toner 10 through electrostatic force or magnetic force or both of them, a feed roller 42 agitating and thus feeding toner 10 to developing roller 41, a doctor blade 43 controlling the thickness of the toner layer carried on the peripheral surface of developing roller 41, and a charger 45 having a grid electrode 45*e* used to charge the toner layer.

The printing head is configured of a jetting electrode 90 and an opposite electrode 91. Each electrode receives a level of voltage depending on a control signal produced in response to an image signal. Then, between jetting electrode 90 and opposite electrode 91 a sheet P corresponding to a recording medium is transported by transport means (not shown) in the Y direction in the figure and when sheet P faces the printing head an image is recorded on the sheet.

Figure 11:
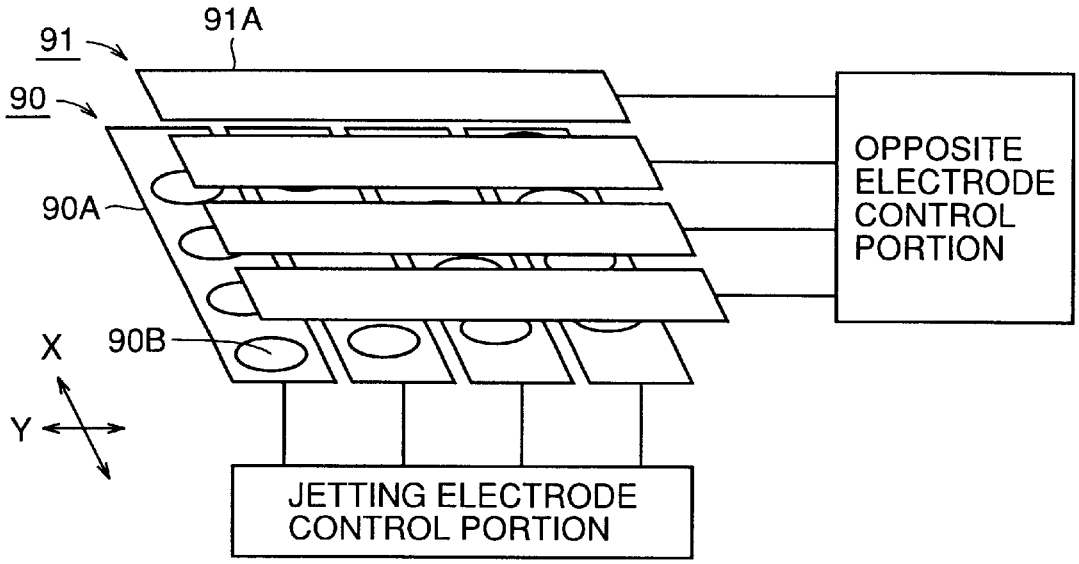
FIG. 11 shows the structure of a jetting electrode.

FIG. 11 shows a configuration of jetting electrode 90 and opposite electrode 91. Jetting electrode 90 is configured of jet control electrodes 90A arranged in the Y direction parallel to each other and opposite electrode 91 is configured of opposite control electrodes 91A arranged in the X direction parallel to each other. Each jet control electrode 90A and each opposite control electrode 91A intersect each other. Each jet control electrode 90A has a plurality of circular openings 90B in the direction of the width of sheet P (in the X direction in the figure) forming a gate in its longitudinal direction and it can thus pass a toner stream from developing roller 41 to opposite electrode 91. Opening 90B is for example of $\phi 60\ \mu m$ and formed in the X direction and spaced by 168 $\mu m$ (equal to 42 $\mu m \times 4$). Furthermore, between jet control electrodes 90A openings 90B are positioned offset by 42 $\mu m$ in the X direction. Thus a resolution of 600 DPI can be achieved in recording an image.

As shown in FIG. 11, opposite electrode 91 is formed of an insulator in the form of a flat plate provided parallel to the direction of a tangent to a surface of developing roller 41 or an arcuate or cylindrical insulator arranged parallel to developing roller 41, and a plurality of opposite control electrodes 91A provided thereon in the form of an elongate plate arranged parallel to each other in the Y direction corresponding to the direction in which sheet P is transported. Opposite electrode 91 and jetting electrode 90 each receive from a control unit a potential provided in response to an image signal. This potential varies an electric field created between developing roller 41 and opposite electrode 91 and thus controls the toner jetting from developing roller 41 to opposite electrode 91.

Figure 12A:
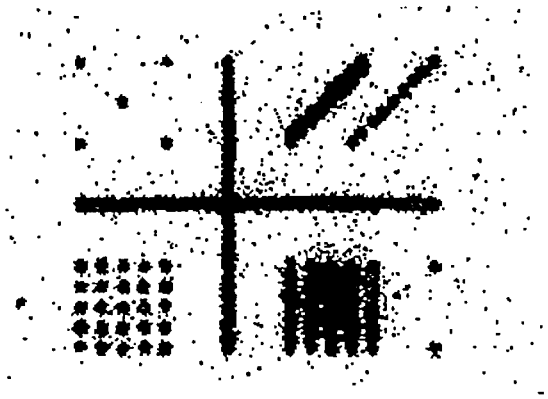
FIG. 12 is an enlarged view of an image formed.

In the above developing device an image is estimated with charger 45 having different levels of grid voltage. The results are provided in FIGS. 12A and 12B. FIG. 12A corresponds to a grid voltage of −200 V and FIG. 12B corresponds to a grid voltage of −300 V.

As can be seen from FIG. 12A, for the grid voltage of −200 V, toner scatters in a portion other than a image, resulting in a degraded image quality. This is attributed to crosstalk or inadvertent jetting of toner charged opposite in polarity that should be present in a portion where an electric field preventing toner from jetting is formed.

Figure 12B:
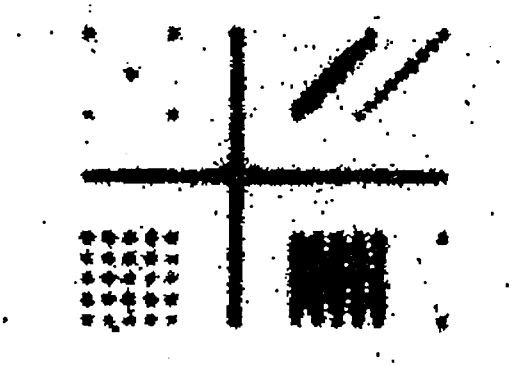

Furthermore, it can be seen from FIG. 12B that for the grid voltage of −300 V an image of high quality can be obtained with a small amount of toner scattered and there hardly exists toner charged opposite in polarity. Furthermore, for the grid voltage of −300 V a pulsed current is observed in the developing roller and, as has been described in the first embodiment, the toner layer has an internal electric discharge.

Figure 13:
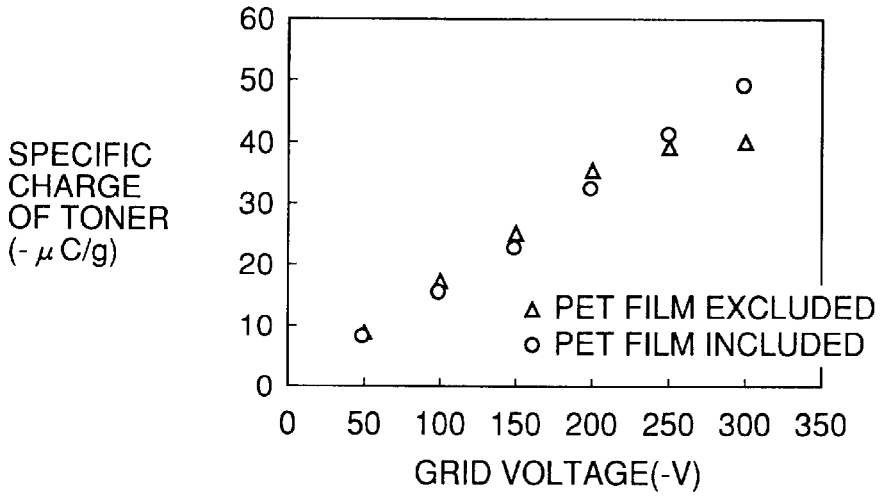
FIG. 13 is a graph of the averaged level of the charge level of toner versus grid voltage.

Then, there were prepared a developing roller having a rotation axis formed of stainless steel and 18 mm in diameter and having a surface provided thereon with a semiconducting elastic layer of 8 mm in thickness covered with a PET film of 10 $\mu m$ in thickness, and a developing roller excluding the PET film. On each roller a toner layer was formed to examine the relationship between grid voltage and the level of the charge to mass ration of the toner layer. The results are shown in FIG. 13. As can be seen from the figure, using the insulating PET film can provide a higher discharge starting electric field in the toner layer and as a result provide the toner with a high charge to mass ration. Higher levels of charge to mass ration improve the controllability provided through electrostatic force and thus provide improved image qualities.

It should be noted that if toner has been consumed on recording medium P and there still remains electric charge on the PET film serving as a dielectric, the remaining electric charge can prevent the subsequent toner layer from being charged to have a desired level of charge to mass ration. To prevent this, discharging device 44 as shown in FIG. 1 is preferably arranged downstream of the developing area, as seen in the direction in which the roller rotates.

Fourth Embodiment

Figure 14:
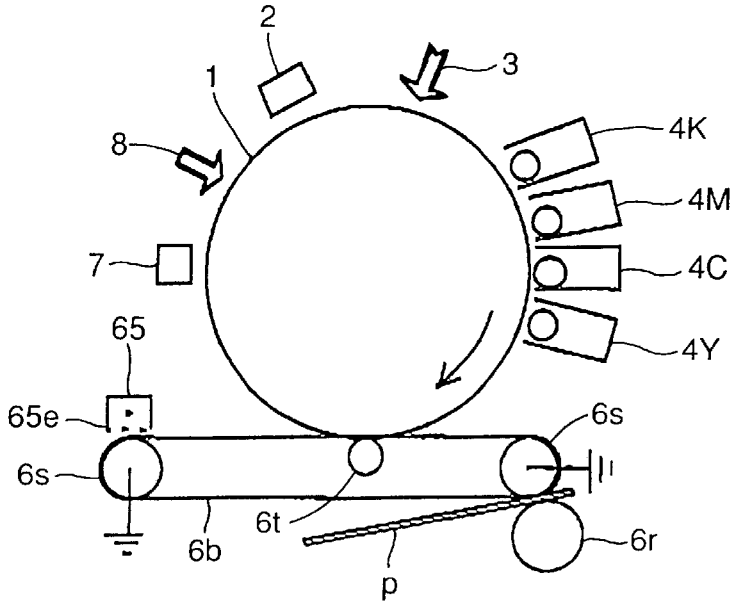
FIG. 14 schematically shows another image formation apparatus.

FIG. 14 shows another embodiment of the image formation apparatus in accordance with the present invention.

The FIG. 14 image formation apparatus is distinguished from FIG. 1 described in the first embodiment in that four developing devices 4K, 4M, 4C 4Y are arranged along a circumference of photoreceptor 1 and that there are provided an intermediate transfer belt 6*b* temporarily holding an image on photoreceptor 1 developed by a developing device for superimposing images developed by the developing devices, a transfer roller 6*r* transferring to a transfer sheet P an image formed on intermediate transfer belt 6*b*, and a charger 65 having a grid electrode 65*e* and provided upstream of the position at which transfer roller 6*r* and intermediate transfer belt 6*b* meet, as seen in the direction in which intermediate transfer belt 6*b* moves. Intermediate transfer belt 6*b* is a seamless, elastic belt formed for example of rubber of 1 mm in thickness and having a resistance controlled with a typical conducting agent such as carbon black. It is movably supported by two rotatably supporting rollers 6*s*. Transfer roller 6*r* is formed of a rotative shaft formed of stainless steel having a diameter of 8 mm and a semiconducting elastic layer provided in the form of sponge of 5 mm covering a surface of the rotative shaft. Transfer roller 6*r* is detachably attached to intermediate transfer belt 6*b*.

On photoreceptor 1, having a surface charged to a desired potential by a charging device 2, a potential of a latent image is formed by an exposure device 3 according to image information. Then on electrostatic latent image formed on photoreceptor 1 moves as photoreceptor 1 rotates, and the electrostatic latent image thus faces developing device 4K. According to a pattern of the latent image, the black toner prepared in developing device 4K moves to photoreceptor 1 and the image is thus revealed. After the potential of the latent image on photoreceptor 1 has been revealed with toner, photoreceptor 1 revolves and meets intermediate transfer belt 6*b*. Intermediate transfer belt 6*b* receives a transfer voltage from a bias roller 6*t* supported opposite to that portion of photoreceptor 1 meeting intermediate transfer belt 6*b*. Thus the tonered image on photoreceptor 1 is transferred to intermediate transfer belt 6*b*. After intermediate transfer belt 6*b* has moved past the region at which it meets photoreceptor 1, a cleaner 7 removes from photoreceptor 1 the toner which has not been transferred and thus remains on photoreceptor 1. Then photoreceptor 1 is refreshed by an optical discharging lamp 8 erasing residual electric charge of photoreceptor 1 and photoreceptor 1 thus returns to the initial step. The above process is repeated by successively operating developing devices 4M (magenta toner), 4C (cyan toner) and 4Y (yellow toner), superimposing a tonered image of each color on intermediate transfer belt 6*b*. When the above operation has been completed, charger 65 is operated in synchronism with the tonered image on intermediate transfer belt 6*b* to charge the tonered image on intermediate transfer belt 6*b*. Furthermore, transfer roller 6*r*, which has so far waited away from intermediate transfer belt 6*b*, moves to contact transfer belt 6*b* and transfer sheet P, fed by a feeding device (not shown), is transported to where transfer roller 6*r* and transfer belt 6*b* contact each other and transfer sheet P contacts the tonered image on intermediate transfer belt 6*b*. Transfer roller 6*r* receives voltage of a polarity allowing the tonered image on intermediate transfer belt 6*b* to move to transfer sheet P so as to transfer to transfer sheet P the tonered image formed on intermediate transfer belt 6*b*. Transfer sheet P having the tonered image transferred thereto is typically transported to a thermal fixing device (not shown) and transfer sheet P thus has the tonered image fused and thus fixed thereon before it is output.

Figure 15A:
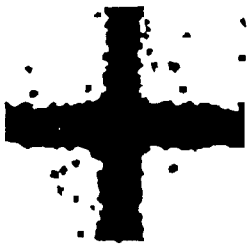
FIG. 15 is an enlarged view of an image formed.
Figure 15B:
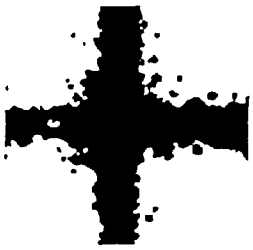
Figure 16:
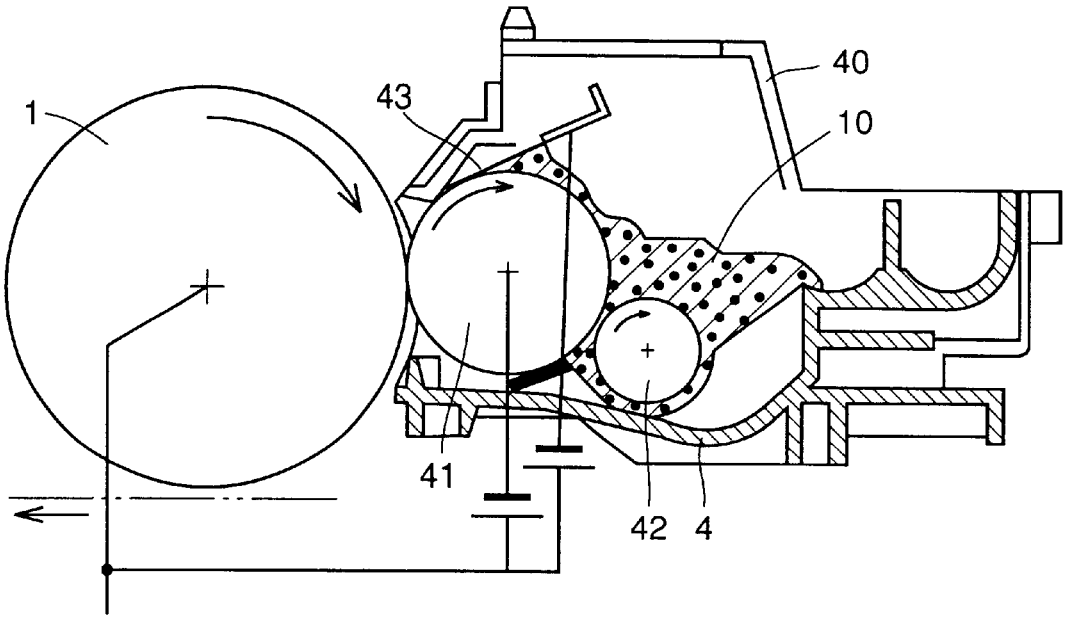
FIG. 16 PRIOR ART
FIG. 16 is a schematic view of a conventional developing device.
Figure 17:
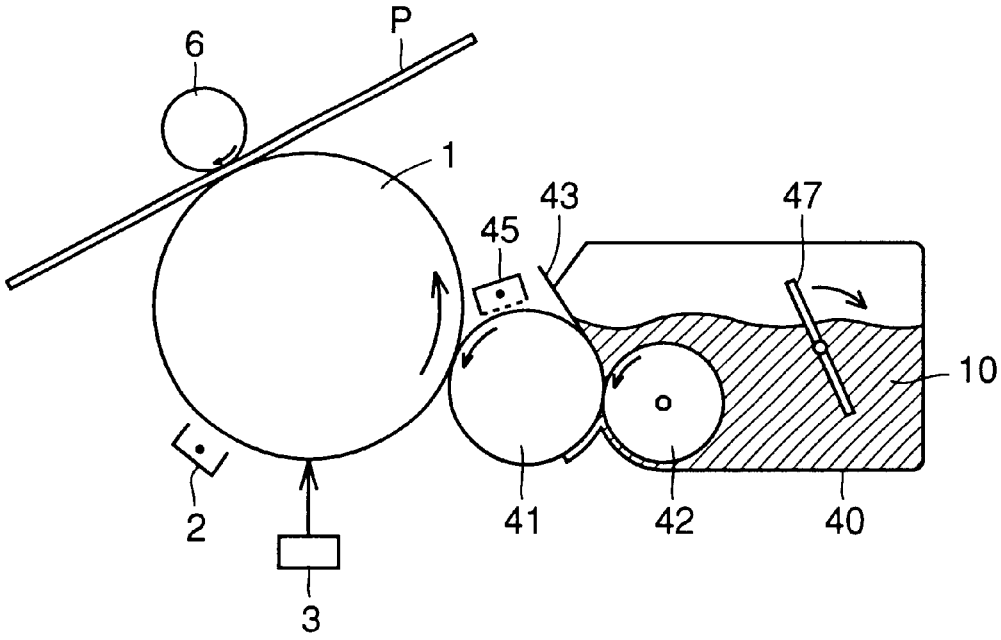
FIG. 17 PRIOR ART
FIG. 17 is a schematic view of an image formation apparatus of a conventional electrophotography system.
Figure 18:
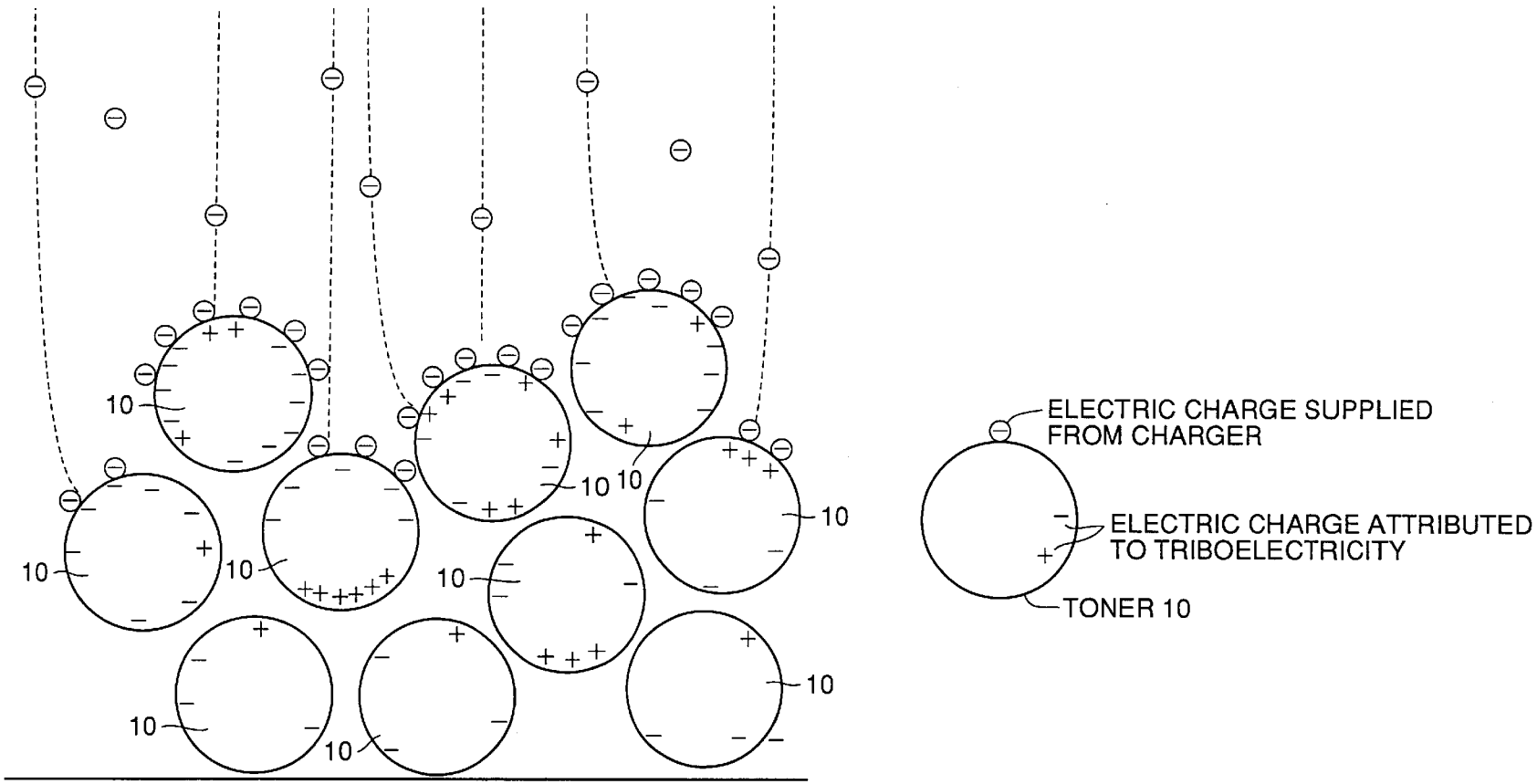
FIG. 18 is an image of toner charged in a conventional developing device.

An image was formed by the above image formation apparatus, with charger 65 having a variable grid voltage, and the image thus formed was estimated, as shown in FIGS. 15A and 15B, which show an image for a grid voltage of 50V and an image for a grid voltage of 120V, respectively. It can be understood that in FIG. 16A, for the grid voltage of 50V, a line has a shaggy edge and is thus degraded in image quality, whereas in FIG. 15B, for the grid voltage of 120V, a line is transferred with fidelity. This experiment employs an intermediate transfer belt having a small volume resistance ($10^6$ Ω·cm) and it is thus apparent that the toner layer's surface potential as measured on the intermediate transfer belt does not reach a grid voltage of around 60V and thereabove. If an intermediate transfer belt of high resistance is used to reliably transfer an image from the photoreceptor to the intermediate transfer belt, the toner layer's surface potential as measured on the intermediate transfer belt follows an increasing grid voltage. This is because the intermediate transfer belt holds a potential difference and in this case a charging condition can be known by obtaining a relationship between the toner layer's surface potential (Vs) and the grid voltage, wherein a potential difference of the toner layer (~Vs)=a surface potential of the toner layer as measured on the intermediate transfer belt (Vs'), a surface potential of the intermediate transfer belt after the toner layer has been removed (Vb). More specifically, there may be applied any bias voltage of the charger relative to which a potential difference of the toner layer no longer increases proportionally. Furthermore, if an intermediate transfer belt of high resistance is used, to provide a more definite potential and rapidly drain the electric charge moving internal to the intermediate transfer belt the rotatably supporting roller 6*s* may be grounded and the charger 65 may be provided opposite thereto or a conductor such as a thin metal film may be provided inwardly of the intermediate transfer belt. While in the above description, tonered images of four colors are superposed before the tonered images are charged, a tonered image of each color may be charged independently whenever it is formed on intermediate transfer belt 6*b*. Furthermore, while the present example has described the fidelity with which an image is transferred, the present invention can also be applied to a process provided in a pre-step for cleaning a photoreceptor more effectively, such as charging toner which has not been transferred and thus remains on the photoreceptor, inverting a polarity charging toner to a polarity opposite an initial polarity to match them, and the like.

Thus, the present invention provides a developing device and image formation apparatus dispensing with subtly adjusting the components of the developer of interest and also allowing the charge level to have a narrow distribution range, canceling the electric charge of toner charged opposite in polarity, charging the toner to an appropriate level of charge to mass ration to provide stable development and also improve image quality.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A developing device comprising a developer carrier having a surface carrying a one-component developer thereon, a developer control member abutting against said developer carrier to control a thickness of a layer of said developer, and a charge generation device provided downstream of said developer control member, as seen in a direction of a rotation of said developer carrier, and applying electric charge of a single polarity to a developer layer on said developer carrier, characterized in that said developer is charged with a bias voltage having at least a level where a surface potential of the developer layer no longer increases in proportion to an increase of the bias voltage of said charge generation device.

2. The developing device of claim 1, wherein said developer is charged with a bias voltage having at most a level where a charge level of said developer decreases as the bias voltage of said charge generation device increases.

3. The developing device of claim 1, wherein the surface potential of said developer on said developer carrier is compared with a voltage applied to said charge generation device, to control a condition for charging said developer.

4. The developing device of claim 1, wherein in charging said developer an electric current flowing through said developer carrier is referred to to control a condition for charging said developer.

5. A developing device comprising a developer carrier having a surface carrying a one-component developer thereon, developer control member abutting against said developer carrier to control a thickness of a layer of said developer, and a charge generation device provided downstream of said developer control member, as seen in a direction of a rotation of said developer carrier, and applying electric charge of a single polarity to a developer layer on said developer carrier, characterized in that said developer is charged at a condition that small aerial discharge occurs in said developer layer by an electric field created by electric charge applied to a surface of the developer layer.

6. The developing device of claim 5, wherein the surface potential of said developer on said developer carrier is compared with a voltage applied to said charge generation device, to control a condition for charging said developer.

7. The developing device of claim 5, wherein in charging said developer an electric current flowing through said developer carrier is referred to to control a condition for charging said developer.

8. An image formation apparatus comprising an electrostatic latent image carrier bearing an electrostatic latent image, a developer carrier having a surface carrying a one-component developer thereon and contacting said electrostatic latent image carrier in a developing portion or facing said electrostatic latent image carrier in a developing portion with a small gap interposed, a developer control member abutting against said developer carrier to control a thickness of a layer of said developer, and a charge generation device arranged downstream of said developer control member, as seen in a direction of a rotation of said developer carrier, and applying electric charge of a single polarity to a developer layer on said developer carrier, characterized in that said developer is charged with a bias voltage having at least a level where a surface potential of the developer layer no longer increases in proportion to an increase of the bias voltage of said charge generation device.

9. The image formation apparatus of claim 8, wherein said developer is charged with a bias voltage having at most a level where a charge level of said developer decreases as the bias voltage of said charge generation device increases.

10. The image formation apparatus of claim 8, wherein a density of an image formed on said electrostatic latent image carrier is referred to to alter a bias voltage of said charge generation device to control a charge level of said developer.

11. An image formation apparatus comprising an electrostatic latent image carrier bearing an electrostatic latent image, a developer carrier having a surface carrying a one-component developer thereon and contacting said electrostatic latent image carrier in a developing portion or facing said electrostatic latent image carrier in a developing portion with a small gap interposed, a developer control member abutting against said developer carrier to control a thickness of a layer of said developer, and a charge generation device arranged downstream of said developer control member, as seen in a direction of a rotation of said developer carrier, and applying electric charge of a single polarity to a developer layer on said developer carrier, characterized in that said developer is charged at a condition small aerial discharge occurs in said developer layer by an electric field created by electric charge applied to a surface of the developer layer.

12. The image formation apparatus of claim 11, wherein a density of an image formed on said image carrier is referred to to alter a bias voltage of said charge generation device to control a charge level of said developer.

13. An image formation apparatus comprising a developer carrier having a surface carrying a one-component developer thereon, a developer control member abutting against said developer carrier to control a thickness of a layer of said developer, a charge generation device arranged downstream of said developer control member, as seen in a direction of a rotation of said developer carrier, and applying electric charge of a single polarity to a developer layer on said developer carrier, and a printing head including a control electrode having a plurality of holes to discontinuously jet said developer in response to an electrical signal corresponding to data of an image to be recorded, characterized in that said developer is charged with a bias voltage having at least a level where a surface potential of the developer layer no longer increases in proportion to an increase of the bias voltage of said charge generation device.

14. The image formation apparatus of claim 13, wherein said developer is charged with a bias voltage having at most a level where a charge level of said developer decreases as the bias voltage of said charge generation device increases.

15. The image formation apparatus of claim 13, wherein the surface potential of said developer on said developer carrier is compared with a voltage applied to said charge generation device, to control a condition for charging said developer.

16. The image formation apparatus of claim 13, wherein in charging said developer an electric current flowing through said developer carrier is referred to to control a condition for charging said developer.

17. An image formation apparatus comprising a developer carrier having a surface carrying a one-component developer thereon, a developer control member abutting against said developer carrier to control a thickness of a layer of said developer, a charge generation device arranged downstream of said developer control member, as seen in a direction of a rotation of said developer carrier, and applying electric charge of a single polarity to a developer layer on said developer carrier, and a printing head including a control electrode having a plurality of holes to discontinuously jet said developer in response to an electrical signal corresponding to data of an image to be recorded, characterized in that said developer is charged at a condition that small aerial discharge occurs in said developer layer by an electric field created by electric charge applied to a surface of the developer layer.

18. The image formation apparatus of claim 17, wherein the surface potential of said developer on said developer carrier is compared with a voltage applied to said charge generation device, to control a condition for charging said developer.

19. The image formation apparatus of claim 17, wherein in charging said developer an electric current flowing through said developer carrier is referred to to control a condition for charging said developer.

20. An image formation apparatus comprising an image forming body having a surface bearing a developer thereon, and a charge generation device positioned upstream of a position allowing said developer on said image forming body to be transferred to an image holder, as seen in a direction of a movement of said image forming body, for applying electric charge of a single polarity to said developer on said image forming body, characterized in that said developer is charged with a bias voltage having at least a level where a surface potential of the developer layer no longer increases in proportion to an increase of the bias voltage of said charge generation device.

21. The image formation apparatus of claim 20, wherein said developer is charged with a bias voltage having at most a level where a charge level of said developer decreases as the bias voltage of said charge generation device increases.

* * * * *